United States Patent [19]

Egler et al.

[11] Patent Number: 4,745,898

[45] Date of Patent: May 24, 1988

[54] PRE-INJECTION APPARATUS FOR INTERNAL COMBUSTION ENGINES

[75] Inventors: Walter Egler; Nestor Rodriquez-Amaya, both of Stuttgart, Fed. Rep. of Germany

[73] Assignee: Robert Bosch GmbH, Stuttgart, Fed. Rep. of Germany

[21] Appl. No.: 91,138

[22] Filed: Aug. 31, 1987

[30] Foreign Application Priority Data

Sep. 1, 1986 [DE] Fed. Rep. of Germany ..... 3629751

[51] Int. Cl.[4] ..... F02M 39/00

[52] U.S. Cl. ..... 123/300; 123/506

[58] Field of Search ..... 123/299, 300, 506, 458; 239/88–95, 533.1–533.12; 417/382, 245

[56] References Cited

U.S. PATENT DOCUMENTS

| | | | |
|---|---|---|---|
| 2,173,814 | 9/1939 | Bischof | 123/300 |
| 4,108,383 | 8/1978 | Thoma | 239/533.5 |
| 4,289,098 | 9/1981 | Norberg | 123/299 |
| 4,520,774 | 6/1985 | Sitter | 123/300 |
| 4,590,903 | 5/1986 | Hofmann | 123/300 |
| 4,590,904 | 5/1986 | Wannenwetsch | 123/300 |
| 4,612,905 | 9/1986 | Dietrich | 123/300 |

FOREIGN PATENT DOCUMENTS

| | | | |
|---|---|---|---|
| 289469 | 4/1971 | Austria | 123/300 |
| 1103079 | 3/1961 | Fed. Rep. of Germany | 123/300 |
| 1284687 | 12/1968 | Fed. Rep. of Germany | 123/300 |
| 1576478 | 1/1970 | Fed. Rep. of Germany | 123/300 |
| 2509068 | 9/1976 | Fed. Rep. of Germany | 123/300 |
| 3425460 | 3/1985 | Fed. Rep. of Germany | 123/300 |
| 1235501 | 6/1971 | United Kingdom | 123/300 |

*Primary Examiner*—Carl Stuart Miller

*Attorney, Agent, or Firm*—Edwin E. Greigg

[57] ABSTRACT

In a pre-injection apparatus for Diesel engines, a pre-injection slide that generates a pronounced pressure intensification for the pre-injection in a pressure chamber closed off with respect to the high-pressure side and open toward the injection line is slidably supported in a stepped guide bore and is exposed to the injection pressure of a high-pressure pump. After the execution of a partial stroke ($h_v$), which is responsible for the pre-injection quantity, the pre-injection pressure chamber is opened with a backwards-oriented action toward the high-pressure side and thereby is intially relieved of pressure. The ensuing movement of the pre-injection slide until the complete end of its stroke forms a predeterminable capacity that enables an injection pause. The pre-injection pressure chamber communicates with an electrically triggerable magnetic valve with the low-pressure side or the high-pressure side, so that the shut-off of the pre-injection is possible under certain operating conditions.

23 Claims, 2 Drawing Sheets

PRE-INJECTION APPARATUS FOR INTERNAL COMBUSTION ENGINES

BACKGROUND OF THE INVENTION

The invention is based on an apparatus as defined hereinafter. In a known apparatus for generating pre-injections for internal combustion engines, in particular Diesel engines (German Offenlegungsschrift No. 25 09 068), a fuel injection valve, although it is intended for graduated injection, that is, without a marked time interval or an intervening valve closure between a pre-injection and a main injection, is associated with a pre-injection piston that is preceded coaxially by a main injection piston that mechanically rests directly on the pre-injection piston.

The high fuel pressure produced by an injection pump acts upon the main injection piston, which undergoes a displacement counter to a spring pressure that has a feedback effect on the pre-injection piston, and this displacement causes the pre-injection piston to emit a corresponding pre-injection quantity, and immediately after a predetermined pre-injection stroke is exceeded opens up a connection with the injection line. Although the main injection piston and the pre-injection piston in the known apparatus are embodied as stepped, so that intrinsically a pressure intensification could occur, it is expressly arranged that a fuel quantity having a feedback effect on the main injection piston and located in an outlet-side pressure chamber of the main injection piston is supplied via (throttled) transverse conduits to a pressure reservoir, so that while a pressure intensification is avoided, the injection pressure in the initial stage of injection (i.e., during pre-injection) is absolutely the same as during the main stage, with the single difference that in the initial stage, smaller quantities are injected. In this known fuel injection valve having graduated injection, there is no possibility for providing a pause in injection between the various stages or injection, or for shutting off the pre-injection completely; that is, a direct transition between the two stages takes place, without a pressure change.

It is generally known (German Offenlegungsschrift No. 1 576 478, German patent No. 1 284 687, or Austrian patent No. 289 469) for a fuel injection valve for pre- and main injection to be associated with a small spring-biased pre-injection piston, typically disposed parallel to the nozzle needle, and to subject the high-pressure side of the fuel injection valve to fuel in such a way that initially the pre-injection takes place by the movement of the small pre-injection piston and then the main injection is performed, optionally after an injection pause, once a predetermined state of equilibrium is attained between the faces acted upon by fuel and the spring forces acting upon various control elements or valves. In these known fuel injection valves, there is typically either no pressure intensification or only such a slight one in the vicinity of the pre-injection that by opening up the high-pressure-side fuel connection no seemingly backward-oriented pressure relief is brought about in any case in the pre-injection region by connection of the injection line with the high-pressure side; in the present invention, this is of functionally decisive significance. Since the spring influences and pressure equilibriums vary in their performance because of aging, adaptation to them causes inaccuracies in the desired piston capacity, this capacity being definitive for the injection pause between the pre-injection and the main injection. Finally, in the known fuel injection valves having pre-injection and main injection, the pre-injection cannot be selectively shut off from outside merely by the action of electrical control means.

It is also known (German Offenlegungsschrift No. 34 25 460), but without the possibility of a shutoff of the pre-injection, to embody a differential piston acted upon by the supply pressure of the high-pressure injection pump, which piston in its function as a storage piston, after the end of supply of the pre-injection, executes a distancing stroke that is injection-free and forms an injection pause.

OBJECT AND SUMMARY OF THE INVENTION

It is the object of the invention to provide an apparatus for generating pre-injection quantities in Diesel engines, which is particularly simple in structure yet with which, on the other hand, both a highly accurate metering of the pre-injection quantity and the injection pause are made possible, with the possibility of a selective shutoff of the pre-injection by electrical triggering.

In the apparatus according to the invention, this object is attained with the advantage that after effecting the pre-injection a very high pressure, resulting from the pressure intensification—as a result of which the pre-injection can also be arranged at a time near the beginning of the supply onset—a marked relief of one injection line leading to the injection nozzle takes place, specifically by opening up the communication between the pre-injection pressure chamber with the injection zone (injection line coming from the pump) on the high-pressure side. This relief is effected by the resumption, after this opening up, of the downward movement of the pre-injection slide, which predetermines a specific capacity and thus also enables a precise definition and positioning of the injection pause, until afterward, namely after the pre-injection slide has met its stop, the pressure for the main injection builds up.

Another advantage in this connection is that as a result of the pressure stage formed by the pre-injection slide, the pre-injection quantity is finely metered, and the pressure intensification at the pre-injection slide combines the advantage of this finely metered pre-injection quantity with a long stroke. Then the remaining stroke of the pre-injection slide is definitive for the injection pause, and this remaining stroke, along with the area of the end face of the pre-injection slide, defines the piston capacity.

The selectively actuatable shutoff of the pre-injection, which is possible by electrical signal generation and signal triggering, is effected by relief of the pre-injection pressure chamber via a magnetic valve, either toward the low-pressure feed pump or by means of a bypass around the injection line communicating with the high-pressure pump. In the case of relief toward the feed pump, it is particularly advantageous that a single and in that case central magnetic valve can be used for perhaps a plurality of pre-injection devices. By shutoff of the pre-injection with a (central) magnetic valve of this kind, an injection duration prolongation that occurs at high load and rpm can be prevented, with only slight variations in quantity in general and with accurate metering of the pre-injection quantity, when pre-injection is desired. The magnetic valve need not be triggered for each injection stroke or intake stroke especially; instead, the decision of "pre-injection YES" or "pre-injection NO" can be effected upon entering a predetermined performance graph region, for example of load and rpm of the Diesel engine, and is monitored once again each time transitions correspondingly occur.

If the shutoff of the pre-injection is effected by means of the opening up of a bypass between the pre-injection pressure chamber and the injection line, then there are advantages in terms of the quantity regulation, because no fuel quantities have to be diverted at various times.

The invention will be better understood and further objects and advantages thereof will become more apparent from the ensuing detailed description of preferred embodiments taken in conjunction with the drawings.

DESCRIPTION OF THE PREFERRED EMBODIMENTS

The basic concept of the present invention is to embody a pre-injection apparatus in such a way that a pronounced and clearly definable pre-injection with a predeterminable pause duration interval with respect to the main injection can be realized in Diesel engines, this being done by providing that a pre-injection and relief slide is disposed in the shunt around the injection line leading from the element chamber to the nozzle and is operated such that for the pre-injection, after supply onset, a pressure intensification takes place, which leads to the pre-injection, after the opening up by the pre-injection slide is then relieved backward, as it were, into the injection line, and furthermore an electrically triggerable magnetic valve is provided, which as a shutoff control for the pre-injection either connects the pre-injection pressure chamber with the low-pressure feed pump of connects it in a bypass with the injection line.

Figure 1:
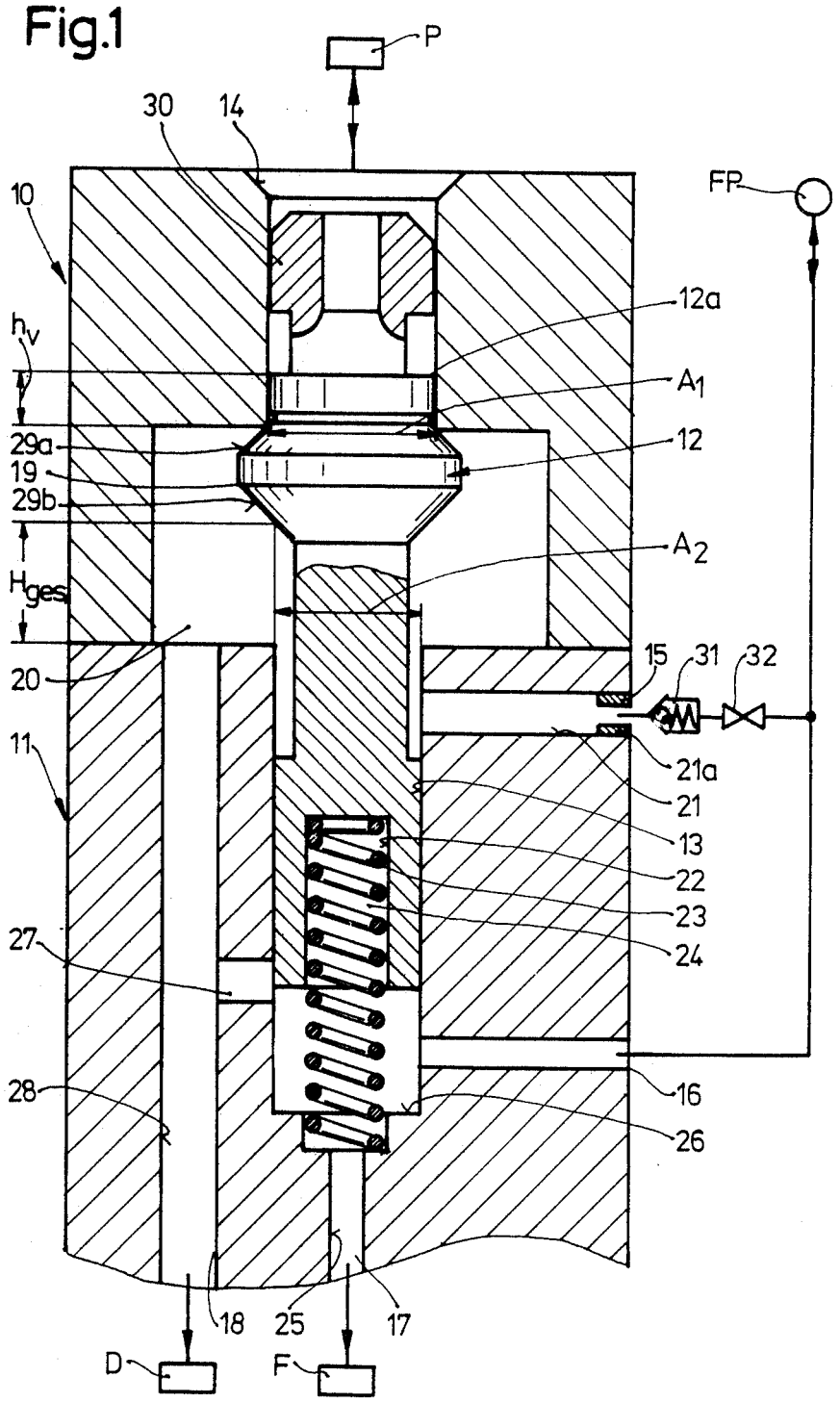
FIG. 1 shows a first exemplary embodiment of the invention, in a schematic sectional view with relief of the pre-injection pressure chamber via a magnetic valve in the vicinity of the low-pressure feed pump.
Figure 2:
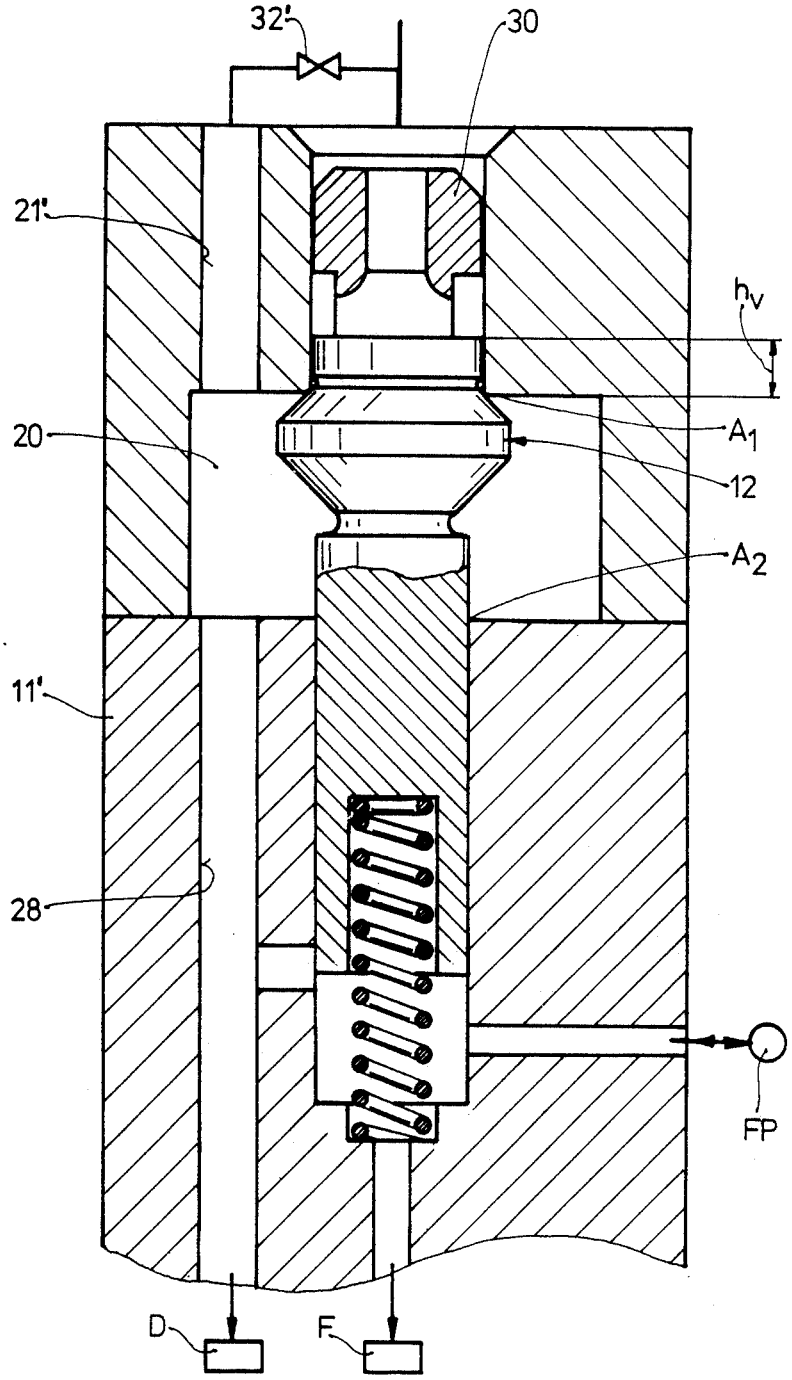
FIG. 2, in a view comparable to that of FIG. 1, shows an embodiment of a pre-injection apparatus having a bypass, controllable via a magnetic valve, between the pre-injection pressure chamber and the high-pressure pump or the injection line.

Both embodiments, in FIG. 1 and FIG. 2, have in common the feature that the pre-injection quantity is derived, by means of a severe pressure intensification, from an initially lower pressure from the high-pressure side, by acting upon a combined pre-injection and relief slide, so that a precisely predeterminable pre-injection quantity can be generated in a chronologically also predeterminable manner with respect to the main injection by appropriate dimensioning of a capacity arising from the movement of the pre-injection slide. The particular pre-injection quantity is not part of the total injection quantity per stroke generated by the action of the high-pressure part, but instead is derived in a shunt from the fuel deriving from the low-pressure side.

Since essential parts are common to the two embodiments of FIGS. 1 and 2, they are identified by the same reference numerals, since they also perform the same functions.

The pre-injection apparatus 10 includes, for example, a cylindrical housing 11, with an inner bore 13 forming a stepped slideway for a pre-injection slide 12.

The housing 11 has a first connection 14, communicating with the high-pressure pump P or injection line, a connection 15 that is effective upon shutoff of the pre-injection and leading to the low-pressure feed pump FP, a relief connection 16 likewise communicating with the low-pressure feed pump, a connection 17 leading to the continuing nozzle spring chamber F, and the pressure connection 18, leading to the nozzle, of the injection line.

The (one-piece) pre-injection and relief slide 12 is stepped in diameter; therefore its diameter above and below a thickened section 19 tapering conically on both sides and forming valve sealing faces differs only slightly. The part of the housing bore 13 oriented toward the injection line together with the associated part of the pre-injection slide 12 is larger in diameter, producing a seat cross section $A_2$, formed by the annular face in the transition from the pre-injection pressure chamber 20 to the lower part of the housing bore 13. The pressure intensification with which the pre-injection is built up and which is attainable after adaptation of the seat face area difference is due to this, that is, to the relationship $A_1 > A_2$, as will be discussed in further detail hereinafter.

In order to keep an outflow conduit 21 leading to the connection 15 open in every position of the pre-injection slide 12, this slide is embodied as tapered in diameter above and below the outflow conduit 21 and widens only farther below to an enlarged diameter that makes possible the flush sliding displacement in the bore 13.

In the lower region, a blind bore 22 in the pre-injection slide 12 receives a restoring biasing spring 23, which keeps it [slide 12] in its upper position as shown in FIG. 1, and forms part of the spring chamber 24. The spring chamber 24 is completed by the housing bore that tapers at 26 and communicates via the relief conduit 25 with the nozzle spring chamber (not shown).

A further connection of the spring chamber 24 results via the connection 16 to the low-pressure feed pump side. Finally, a filling slit 27 is also provided, which only in the returned position of repose, toward the top in the plane of the drawing, of the pre-injection slide and shortly before that connects the low-pressure zone or spring chamber 24 with the injection line 28 that penetrates the housing 11 and leads to the nozzle, not shown. The injection line discharges farther up into the pre-injection pressure chamber 20, in which the thickened section 19 on the pre-injection slide 12 forms the conically extending stop and sealing faces **29*a*, 29*b* on opposite sides, with respect to the seat cross sections $A_1$ and $A_2$. The upper part of the pre-injection slide is seated flush in the upper housing bore for a predetermined distance hv and then, in order to maintain satisfactory guidance of the pre-injection slide in the bore 13, merges with a multiply finned portion 30**, which suitably has longitudinal conduits. The total stroke executed by the pre-injection slide upon each injection is indicated as $H_{ges}$.

Finally, a magnetic valve 32 communicating with the low-pressure side of the feed pump communicates with the outflow conduit 21, via a check valve 31 and optionally via a throttle **21*a*. By electric triggering, this magnetic valve 32** can be closed or opened, so that it is possible either to shut off the pre-injection, as will be explained below, or to maintain it, depending on the operating point in the performance graph at which the Diesel engine has arrived.

The following function then results. If the fuel pressure coming from the pump or injection line during the injection stroke exceeds the opening pressure at the pre-injection slide 12, which pressure is substantially defined by the biasing spring 23, then the injection slide 12 is set in motion downward in the plane of the drawing.

Because of the movement of the pre-injection slide 12 after supply onset, a pressure intensification arises from the ratio of the seat faces $A_1$ to $A_2$, so that at a ratio for instance between 1:5 and 1:15, and preferably 1:9, a pressure stage is formed. If numerical values are assumed, for the sake of better comprehension—it being understood that this does not restrict the invention in this direction—then a pressure intensification of 1:9 and an opening pressure of 30 bar, for example, produce pressures in the pressure chamber 20 and the injection line 28 communicating with it on the order of magnitude of approximately 250 to 300 bar, which are entirely sufficient to effect the desired pre-injection at the nozzle.

Upon a further downward movement of the pre-injection slide 12, as soon as the pressure chamber 20 toward the injection line or pump (oriented toward the rear) is opened up by the upper control edge 12*a* (end of the pre-injection stroke $h_v$), the nozzle pressure drops back again toward the opening pressure, here assumed to be 30 bar; in other words, the pre-injection slide 12 is relieved until attaining the end of its stroke $H_{ges}$; that is, by means of its further downward movement as far as the stop, i.e., by means of the high-pressure zone, it terminates the pre-injection and effects an injection pause that is predeterminable by the given geometrical characteristics. Then, the pressure for the main injection is built up. The basic function of this portion of the present invention is therefore that the pressure stage formed by the pre-injection slide, after attainment of the pre-injection stroke $h_v$, effects relief backward into the element chamber, and because of the defined capacity resulting from the further downward movement initiates a pronounced injection pause, until the lower conical sealing face 29*b* on the seat cross section $A_2$ meets its stop (total stroke $H_{ges}$) and the pressure for the main injection is built up.

It will also be apparent in this connection that after the end of supply, as a result of the relief and the ensuing intake stroke, the pre-injection slide 12 is returned by its biasing spring to the initial position shown in FIG. 3, and from the moment at which the upper control edge again enters into an overlap of the bore forming the pre-injection stroke $h_v$, a hollow space is created in the pressure chamber 20.

This hollow space is refilled with fuel from the spring chamber 24, in the seat position, via the filling slit 27 in the pre-injection slide 12, so that for the next injection stroke the pre-injection quantity that results from the positive displacement, based on the seat cross section relationship of $A_2<A_1$, is available in the pressure chamber 20.

The desired initiation or shutoff of the pre-injection desired at a particular time, for instance depending on the performance graph, is then controlled by the single magnetic valve 32. With the magnetic valve closed, injection takes place, because the pressure stage is operative with the pre-injection pressure chamber 20 closed, while with the magnetic valve open, the fuel pumped into the pre-injection pressure chamber 20 via the filling slit 27 during the intake stroke is initially diverted via 21, 31 and 32 until the closure of the seat cross section $A_2$; after that, the cohesive main injection takes place as usual.

At this point, the distinction between the two embodiments of FIGS. 1 and 2 is apparent. It pertains solely to the possibility of shutting off the pre-injection by dispensing with the connection via 21, 31, 32 to the low-pressure feed pump region that serves to divert the pre-injection quantity volume and providing a bypass that is connected (in load-dependent fashion) via a magnetic valve 32' from the high-pressure region via an additional connecting conduit 21' to the pre-injection pressure chamber 20. Such a connection can also be provided in such a way that the injection line 28 leading to the nozzle is extended all the way through the housing 11; of the pre-injection apparatus, penetrating the pre-injection pressure chamber 20, and thus the pre-injection slide 12, in its shut-off function as shown opens while bypassing the pressure intensification, and only after contacting its lower stop position enables the pressure buildup for a cohesive main injection.

This variant of the shutoff control for the pre-injection can be advantageous in terms of the quantity regulation, because unlike the exemplary embodiment of FIG. 1, no fuel quantity is diverted while the pre-injection is shut off.

All the characteristics described above and claimed hereinafter and shown in the drawing may be essential to the invention taken either individually or in arbitrary combination with one another.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A pre-injection apparatus for internal combustion engines comprising a housing, a high pressure fluid source, a low pressure fuel pump, a pre-injection slide that controls fuel flow to a pre-injection pressure chamber (20), said pre-injection slide having an enlarged area in said pre-injection pressure chamber said enlarged area forming first and second valve faces, said pre-injection pressure chamber having first and second valve seats, said pre-injection slide having an upper end subjected to a fuel pressure generated by said high-pressure fuel source and which undergoes a displacement determining a pre-injection quantity, a spring chamber (24) at a lower end of said pre-injection slide within said housing, a conduit connection between said spring chamber (24) and said fuel injection line, said pre-injection slide enabling a main injection by opening a fuel injection line leading to a nozzle, whereby during a first partial pre-injection stroke ($h_v$) of said pre-injection slide (12), a connection of the high-pressure side to the injection line (28) is kept sealed thereby forming a pressure intensification by means of a pressure stage ($A_2<A_1$) at the pre-injection slide (12) from said spring chamber (24), which transfers a pre-injection quantity to the injection line (28), opening said pre-injection pressure chamber (20) toward the high-pressure side, causes a drop of the nozzle pressure, and the high-pressure side is relieved until a final stroke of the pre-injection slide and a magnetic valve (32, 32') is provided which communicates at least indirectly with the pre-injection pressure chamber (20) to shut-off control of said pre-injection.

2. A pre-injection apparatus as defined by claim 1, in which for shutoff control of the pre-injection, the pre-injection chamber (20) communicates with said low-pressure feed pump.

3. A pre-injection apparatus as defined by claim 1, in which for shutoff control of the pre-injection, the pre-injection chamber (20) communicates with said high-pressure pump via a bypass containing said magnetic valve.

4. A pre-injection apparatus as defined by claim 1, in which the pre-injection slide (12) is slidably supported is a stepped bore (13) of said housing (11) disposed between a high-pressure side and the nozzle, wherein an annular recess in the partial housing, in combination with the stepped bore, by means of different seat cross sections on both sides ($A_2$, $A_1$, with $A_2<A_1$), forms the pressure chamber (20) for the pressure stage serving to effect the pressure intensification for the pre-injection, and the pressure chamber (20) communicates with the injection line (28).

5. A pre-injection apparatus as defined by claim 2, in which the pre-injection slide (12) is slidably supported in a stepped bore (13) of said housing (11) disposed between a high-pressure side and the nozzle, wherein an annular recess in the partial housing, in combination with the stepped bore, by means of different seat cross sections on both sides ($A_2$, $A_1$, with $A_2<A_1$), forms the pressure chamber (20) for the pressure stage serving to effect the pressure intensification for the pre-injection, and the pressure chamber (20) communicates with the injection line (28).

6. A pre-injection apparatus as defined by claim 3, in which the pre-injection slide (12) is slidably supported in a stepped bore (13) of said housing (11) disposed between a high-pressure side and the nozzle, wherein an annular recess in the partial housing, in combination with the stepped bore, by means of different seat cross sections on both sides ($A_2$, $A_1$, with $A_2<A_1$), forms the pressure chamber (20) for the pressure stage serving to effect the pressure intensification for the pre-injection, and the pressure chamber (20) communicates with the injection line (28).

7. A pre-injection apparatus as defined by claim 4, in which said first and second valve seats have seat cross sections ($A_1$, $A_2$) formed by the pre-injection pressure chamber (20) in a transition to a stepped bore (13) of the housing (11), and said first and second valve faces are, respectively, tapering stop and sealing faces (29*a*, 29*b*) on the pre-injection slide (12).

8. A pre-injection apparatus as defined by claim 5, in which said first and second valve seats have seat cross sections ($A_1$, $A_2$) formed by the pre-injection pressure chamber (20) in a transition to a stepped bore (13) of the housing (11), and said first and second valve faces are, respectively, tapering stop and sealing faces (29*a*, 29*b*) on the pre-injection slide (12).

9. A pre-injection apparatus as defined by claim 6, in which said first and second valve seats have seat cross sections ($A_1$, $A_2$) formed by the pre-injection pressure chamber (20) in a transition to a stepped bore (13) of the housing (11), and said first and second valve faces are, respectively, tapering stop and sealing faces (29*a*, 29*b*) on the pre-injection slide (12).

10. A pre-injection apparatus as defined by claim 7, in which a ratio of said seat cross sections ($A_1$, $A_2$) is dimensioned such that with a long pre-injection stroke ($h_v$) of the pre-injection slide (12), a finely metered pre-injection quantity results, with a high pressure intensification (1:5–1:15) as a result of the pressure stage that is formed.

11. A pre-injection apparatus as defined by claim 8, in which a ratio of said seat cross sections ($A_1$, $A_2$) is dimensioned such that with a long pre-injection stroke ($h_v$) of the pre-injection slide (12), a finely metered pre-injection quantity results, with a high pressure intensification (1:5–1:15) as a result of the pressure stage that is formed.

12. A pre-injection apparatus as defined by claim 9, in which a ratio of said seat cross sections ($A_1$, $A_2$) is dimensioned such that with a long pre-injection stroke ($h_v$) of the pre-injection slide (12), a finely metered pre-injection quantity results, with a high pressure intensification (1:5–1:15) as a result of the pressure stage that is formed.

13. A pre-injection apparatus as defined by claim 1, in which said pre-injection slide (12), over the distance of the pre-injection stroke ($h_v$), closes an inflow from the high-pressure side to the injection line (20), and the pre-injection chamber (20) communicates with the injection line (28) leading onward to the nozzle, and that disposed on the lower end of the pre-injection slide (12) is the spring chamber (24) that enables the full stroke ($H_{ges}$) of the pre-injection slide until it comes to a stop on its lower conical ring face (29*b*) on said second valve seat cross section ($A_2$), and the spring chamber (24) communicates with a relief bore (25) to the spring chamber on the nozzle side.

14. A pre-injection apparatus as defined by claim 2, in which said pre-injection slide (12), over the distance of the pre-injection stroke ($h_v$), closes an inflow from the high-pressure side to the injection line (20), and the pre-injection chamber (20) communicates with the injection line (28) leading onward to the nozzle, and that disposed on the lower end of the pre-injection slide (12) is the spring chamber (24) that enables the full stroke ($H_{ges}$) of the pre-injection slide until it comes to a stop on its lower conical ring face (29*b*) on said second valve seat cross section ($A_2$), and the spring chamber (24) communicates with a relief bore (25) to the spring chamber on the nozzle side.

15. A pre-injection apparatus as defined by claim 3, in which said pre-injection slide (12), over the distance of the pre-injection stroke ($h_v$), closes an inflow from the high-pressure side to the injection line (20), and the pre-injection chamber (20) communicates with the injection line (28) leading onward to the nozzle, and that disposed on the lower end of the pre-injection slide (12) is the spring chamber (24) that enables the full stroke ($H_{ges}$) of the pre-injection slide until it comes to a stop on its lower conical ring face (29*b*) on said second valve seat cross section ($A_2$), and the spring chamber (24) communicates with a relief bore (25) to the spring chamber on the nozzle side.

16. A pre-injection apparatus as defined by claim 4, in which said pre-injection slide (12), over the distance of the pre-injection stroke ($h_v$), closes an inflow from the high-pressure side to the injection line (20), and the pre-injection chamber (20) communicates with the injection line (28) leading onward to the nozzle, and that disposed on the lower end of the pre-injection slide (12) is the spring chamber (24) that enables the full stroke ($H_{ges}$) of the pre-injection slide until it comes to a stop on its lower conical ring face (29*b*) on said second valve seat cross section ($A_2$), and the spring chamber (24) communicates with a relief bore (25) to the spring chamber on the nozzle side.

17. A pre-injection apparatus as defined by claim 7, in which said pre-injection slide (12), over the distance of the pre-injection stroke ($h_v$), closes an inflow from the high-pressure side to the injection line (20), and the pre-injection chamber (20) communicates with the injection line (28) leading onward to the nozzle, and that disposed on the lower end of the pre-injection slide (12) is the spring chamber (24) that enables the full stroke ($H_{ges}$) of the pre-injection slide until it comes to a stop on its lower conical ring face (29*b*) on said second valve seat cross section ($A_2$), and the spring chamber (24) communicates with a relief bore (25) to the spring chamber on the nozzle side.

18. A pre-injection apparatus as defined by claim 10, in which said pre-injection slide (12), over the distance of the pre-injection stroke ($h_v$), closes an inflow from the high-pressure side to the injection line (20), and the pre-injection chamber (20) communicates with the injection line (28) leading onward to the nozzle, and that disposed on the lower end of the pre-injection slide (12) is the spring chamber (24) that enables the full stroke ($H_{ges}$) of the pre-injection slide until it comes to a stop on its lower conical ring face (29*b*) on said second valve seat cross section ($A_2$), and the spring chamber (24) communicates with a relief bore (25) to the spring chamber on the nozzle side.

19. A pre-injection apparatus as defined by claim 1, in which the pre-injection slide (12) has a fin-like structure (30) on the upper end for sliding guidance in the enlarged partial bore of the housing (11).

20. A pre-injection apparatus as defined by claim 2, in which the pre-injection slide (12) has a fin-like structure (30) on the upper end for sliding guidance in the enlarged partial bore of the housing (11).

21. A pre-injection apparatus as defined by claim 3, in which the pre-injection slide (12) has a fin-like structure (30) on the upper end for sliding guidance in the enlarged partial bore of the housing (11).

22. A pre-injection apparatus as defined by claim 4, in which the pre-injection slide (12) has a fin-like structure (30) on the upper end for sliding guidance in the enlarged partial bore of the housing (11).

23. A method of pre-injection for internal combustion engines, in particular Diesel engines, which comprises influencing a pre-injection slide under the influence of a fuel pressure generated by a high-pressure side to undergo a displacement determining a pre-injection quantity, with an ensuing enabling of a main injection by opening of an injection line leading to a nozzle, producing a first partial stroke of a pre-injection stroke ($h_v$) of the pre-injection slide (12), connecting a high-pressure side of a fluid pressure to the injection line (28) while maintaining said pre-injection slide in a sealed position forming a pressure intensification by means of a pressure stage ($A_2 < A_1$) at the pre-injection slide (12), transfering the pre-injection quantity to the injection line (28), moving the pre-injection slide to open the pre-injection pressure chamber (20) uptoward the high-pressure side, with a drop of the nozzle pressure, and relieving the high-pressure side of said pre-injection slide until the final stroke of the pre-injection slide, and controlling the pre-injection quantity to a desired amount.

* * * * *